US008314526B2

(12) United States Patent
Fukuda et al.

(10) Patent No.: US 8,314,526 B2
(45) Date of Patent: Nov. 20, 2012

(54) ENGINE GENERATOR

(75) Inventors: Toru Fukuda, Wako (JP); Yuki Satoh, Wako (JP); Ryuji Tsuru, Wako (JP); Kosei Yamashita, Wako (JP)

(73) Assignee: Honda Motor Co., Ltd, Tokyo (JP)

( * ) Notice: Subject to any disclaimer, the term of this patent is extended or adjusted under 35 U.S.C. 154(b) by 761 days.

(21) Appl. No.: 12/482,025

(22) Filed: Jun. 10, 2009

(65) Prior Publication Data

US 2009/0314228 A1 Dec. 24, 2009

(30) Foreign Application Priority Data

Jun. 23, 2008 (JP) ..... 2008-163557

(51) Int. Cl.
*F02F 1/34* (2006.01)

(52) U.S. Cl. ..... 310/89; 310/87; 310/88

(58) Field of Classification Search ..... 310/87–89; 123/41.6

See application file for complete search history.

(56) References Cited

U.S. PATENT DOCUMENTS

| | | | | |
|---|---|---|---|---|
| 4,766,337 | A * | 8/1988 | Parkinson et al. | 310/58 |
| 5,121,715 | A * | 6/1992 | Nogami et al. | 123/41.7 |
| 6,028,369 | A * | 2/2000 | Hirose et al. | 290/1 A |
| 6,784,574 | B2 * | 8/2004 | Turner et al. | 310/58 |
| 7,392,770 | B2 * | 7/2008 | Xiao | 123/41.7 |
| 2005/0134129 | A1 * | 6/2005 | Sato et al. | 310/88 |
| 2008/0127912 | A1 * | 6/2008 | Onodera et al. | 123/2 |
| 2008/0134996 | A1 * | 6/2008 | Onodera et al. | 123/41.6 |

FOREIGN PATENT DOCUMENTS

JP 7-30565 U 6/1995

* cited by examiner

*Primary Examiner* — Quyen Leung
*Assistant Examiner* — Naishadh Desai
(74) *Attorney, Agent, or Firm* — Arent Fox LLP

(57) ABSTRACT

An engine generator is disclosed in which an engine drives a generator and causes a cooling fan to rotate to cool the generator. The generator includes an intake duct having an intake port provided in a lower portion thereof and oriented downward. Moisture-containing outside air sucked through the intake port impinges on a barrier plate disposed in the intake duct. The barrier plate is located above the intake port and faces the intake port. The moisture adheres to the barrier plate in the form of water droplets, which then fall toward the intake port after having separated from the outside air.

4 Claims, 7 Drawing Sheets

ENGINE GENERATOR

FIELD OF THE INVENTION

The present invention relates to an engine generator (engine-generator assembly) in which an engine is driven to drive a generator and to rotate a cooling fan and cooling air sucked by the cooling fan is guided into the generator.

BACKGROUND OF THE INVENTION

Some engine generators include an air inlet on a sidewall of an enclosure, an intake duct communicating with the air inlet, and an intake port of the intake duct oriented downward. An exemplary engine generator of this type is disclosed in Japanese Utility Model Application Laid-Open Publication No. 07-030565.

Outside air introduced through the intake port is guided through the intake duct and the air inlet into the generator, and cools the generator.

According to the engine generator disclosed in Japanese Utility Model Application Laid-Open Publication No. 07-030565, forming the intake port of the intake duct so as to be oriented downward can prevent rainwater from directly entering the intake port when the engine generator is used outdoors, for example, in an environment subject to water.

Even when the intake port of the intake duct is formed to be oriented downward, it is conceivable that rainwater bouncing upward off the ground or any other surface enters (spatters into) the intake port in the form of airborne moisture and water mist. As a result, the airborne moisture and water mist having entered the intake port could be disadvantageously contained in the air and guided into the generator along with the air.

SUMMARY OF THE INVENTION

It is therefore an object of the invention to provide an engine generator capable of preventing moisture contained in the air from being guided into the generator.

According to an aspect of the present invention, there is provided an engine generator in which an engine drives a generator and causes a cooling fan to rotate, and cooling air sucked by the cooling fan is guided into the generator through a plurality of air inlets on the generator, the engine generator comprising: an intake duct having a duct space communicating with the plurality of air inlets; an intake port provided in a lower portion of the intake duct, oriented downward, and communicating with the duct space; a partition vertically disposed from an edge of the intake port and facing the lower half of the air inlets; and a first barrier plate extending from the partition sideward into the duct space and facing the intake port. The first barrier plate changes the flowing direction of the air sucked through the intake port from upward to sideward. The air flowing sideward is forced to travel upward along a wall of the intake duct. The air traveling upward is guided through the air inlets into the generator.

The first barrier plate causes the air sucked through the intake port to flow sideward, whereby the air flow path can be extended and the flow rate of the air can be lowered. When the air flows along the extended flow path at the lowered flow rate, the moisture contained in the air has a higher chance of falling on its own and separating from the air. Therefore, even when rainwater bounced upward off the ground or other surfaces becomes airborne moisture and water mist and enters (spatters into) the intake port, the airborne moisture and water mist can be separated from the air. In this way, the moisture contained in the air will not be guided into the generator.

Preferably, the first barrier plate has a front end and a folded portion folded at the front end and oriented downward. Water droplets adhering to the first barrier plate are guided to the folded portion by the air flowing sideward. The water droplets having been guided to the folded portion travel downward along the folded portion and fall from a lower end of the folded portion. The moisture contained in the air can thus be separated.

Desirably, the first barrier plate extends sideward and is inclined downward in the duct space in such a way that a front end is lower than the rest of the first barrier plate. Therefore, water droplets adhering to the first barrier plate flow down to the front end and efficiently fall therefrom. In this way, the moisture contained in the air is further adequately separated.

In a preferred form, the intake duct includes a second barrier plate disposed on the portion of the intake duct wall where the air flowing sideward along the first barrier plate is forced to flow upward, the second barrier plate projecting obliquely downward in such a way that a front end is in a relatively lower position. The air traveling upward along the intake duct therefore impinges on the second barrier plate, and the moisture contained in the air adheres to the second barrier plate in the form of water droplets. The water droplets adhering to the second barrier plate flow down to the front end and efficiently fall therefrom. In this way, the moisture contained in the air can be further separated.

BRIEF DESCRIPTION OF THE DRAWINGS

Preferred embodiments of the invention will be described in detail below, by way of example only, with reference to the accompanying drawings, in which.

DETAILED DESCRIPTION OF THE PREFERRED EMBODIMENTS

Figure 1:
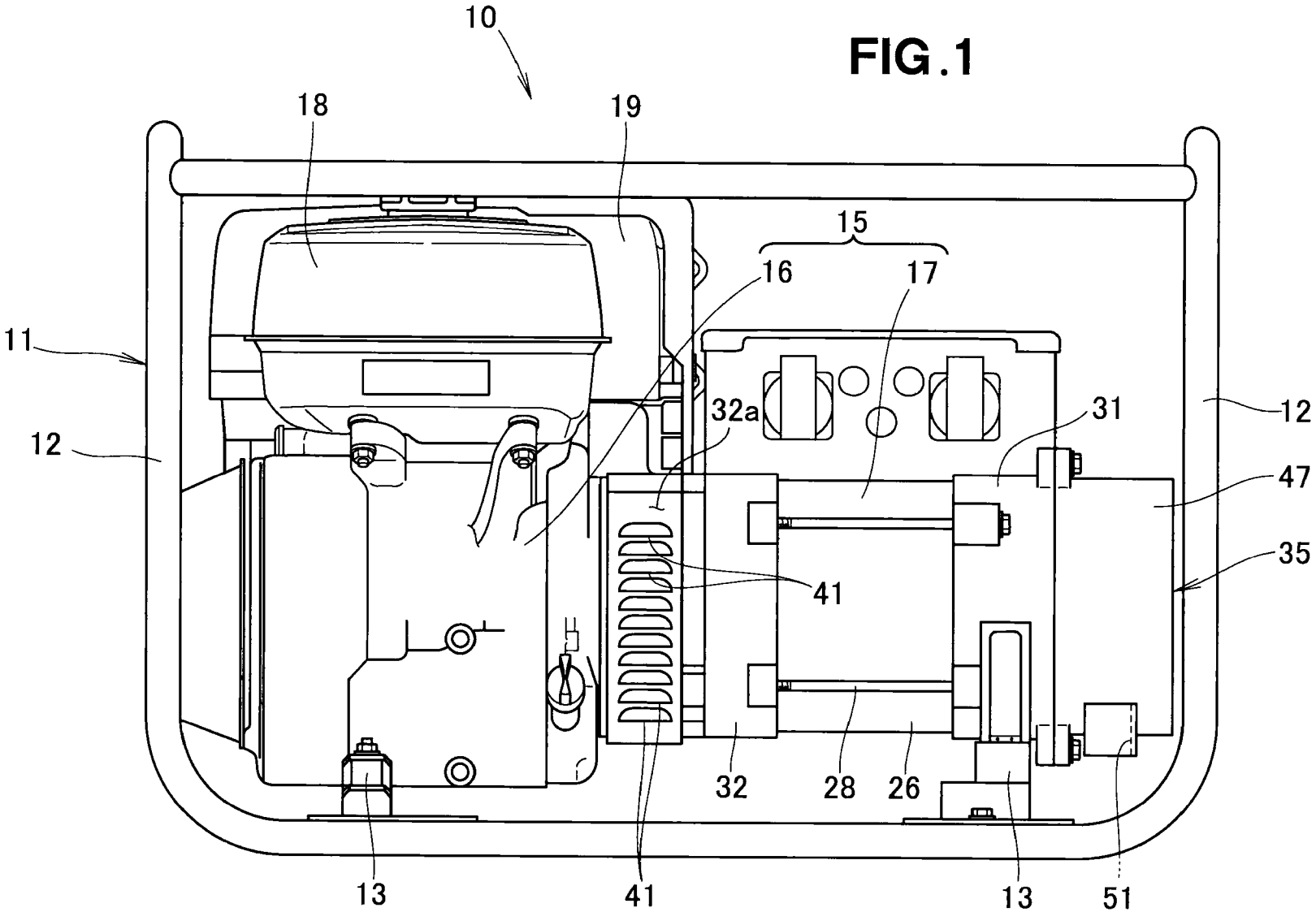
FIG. 1 is a front elevational view illustrating an engine generator (engine-generator assembly) according to a first embodiment of the present invention.

An engine generator 10 according to the embodiment shown in FIG. 1 includes a substantially cubic frame 11 comprising a plurality of columns 12 or other components, an engine-generator assembly 15 provided in the frame 11 with attachment members 13 therebetween, and a fuel tank 18 and an air cleaner 19 provided above an engine 16 in the engine-generator assembly 15.

Figure 2:
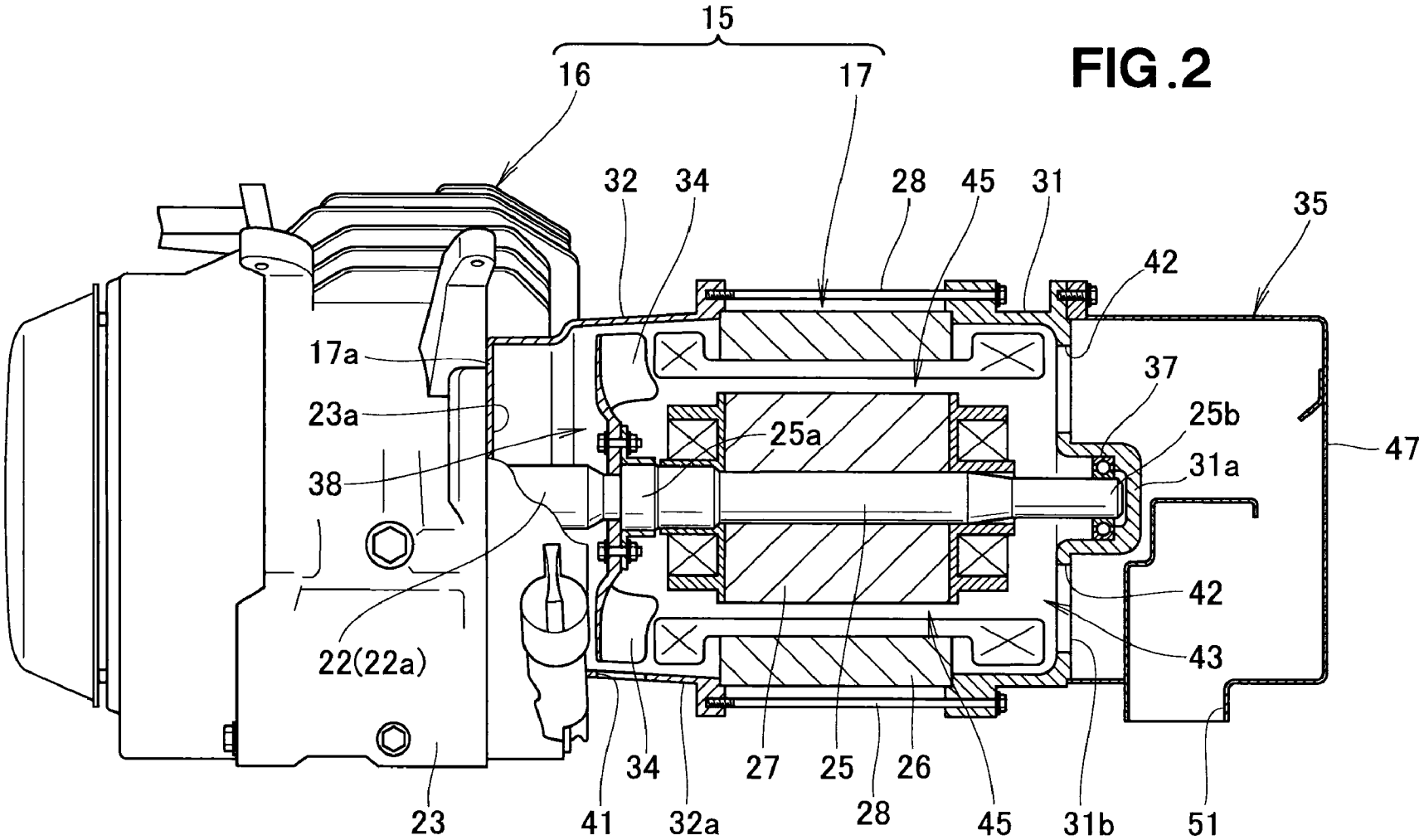
FIG. 2 is a cross-sectional view showing the engine-generator assembly of FIG. 1.

As shown in FIG. 2, the engine-generator assembly 15 according to the first embodiment includes the engine 16 and a generator 17 provided coaxially with a crankshaft (output shaft) 22 of the engine 16.

A front end 22*a* of the crankshaft 22 protrudes from a front wall 23*a* of a crankcase 23. A rear end 17*a* of the generator 17 is located at the front wall 23*a* of the crankcase 23. A rear end 25*a* of a drive shaft 25 of the generator 17 is coaxially connected to the front end 22*a* of the crankshaft 22.

The generator 17 includes a stator 26, a rotor 27 disposed in the stator 26 around the drive shaft 25, front and rear covers 31, 32 attached to the front and rear ends of the stator 26 with a plurality of bolts 28, a cooling fan 34 provided in the rear cover 32, and an intake duct 35 attached to the front cover 31.

A front end 25*b* of the drive shaft 25 is rotatably supported by a central portion 31*a* of the front cover 31 via a bearing 37. The cooling fan 34 is disposed in a space 38 in the rear cover 32. The cooling fan 34 is provided at the rear end 25*a* of the drive shaft 25 coaxially therewith.

A plurality of louver-shaped air outlets 41 (see FIG. 1) is formed in a circumferential wall 32*a* of the rear cover 32. The plurality of air outlets 41 communicates with the space 38 in the rear cover 32.

A plurality of air inlets 42 is formed in a front wall 31*b* of the front cover 31. The plurality of air inlets 42 communicates with a cooling air sucking path 45 through a space 43 in the front cover 31. The cooling air sucking path 45 is formed in the space between the stator 26 and the rotor 27 in the generator 17.

Figure 3:
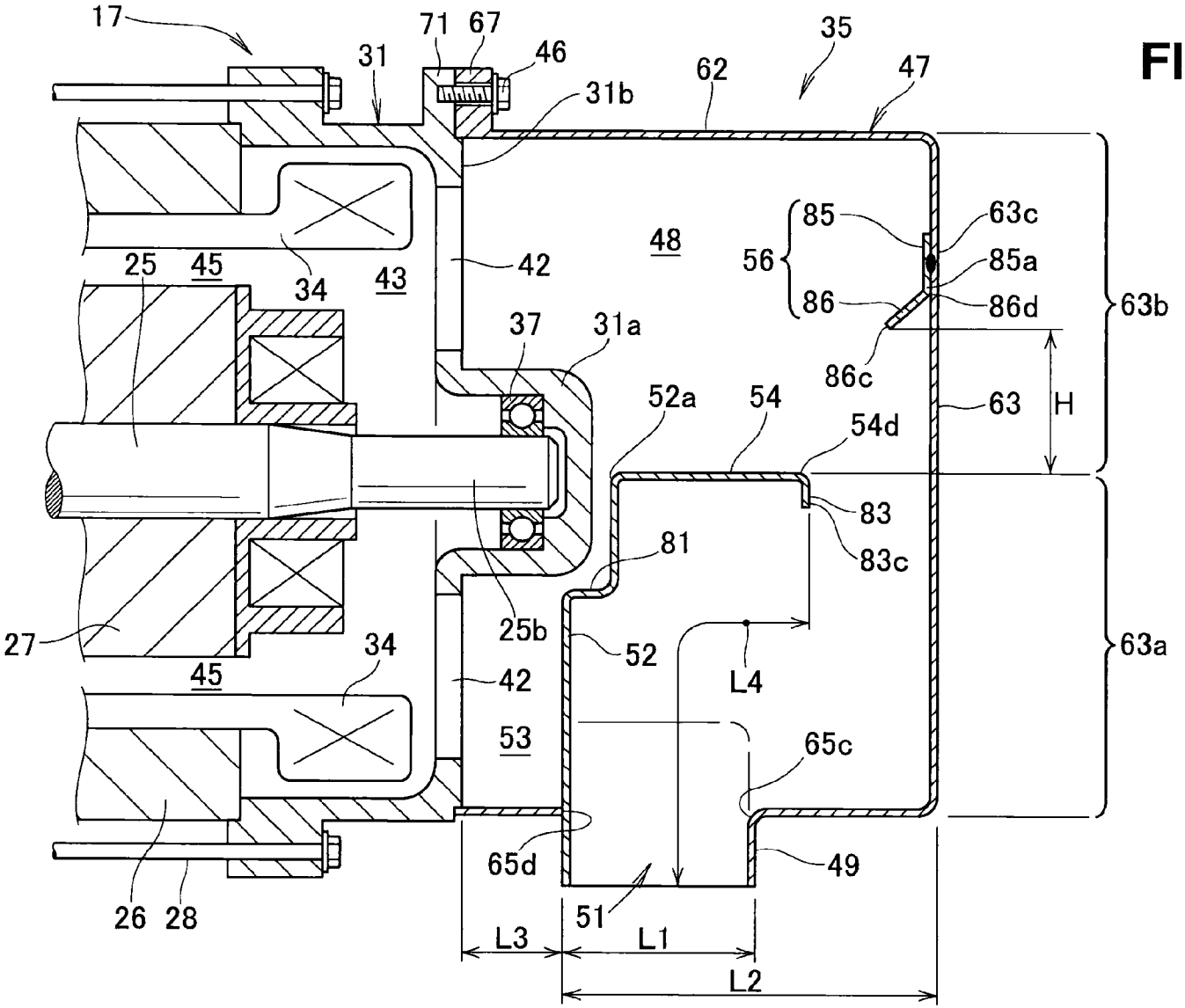
FIG. 3 is a cross-sectional view showing an intake duct of FIG. 2.

As shown in FIG. 3, the intake duct 35 according to the first embodiment is attached to the front cover 31 with a plurality of bolts 46.

The intake duct 35 includes a duct cover 47 that forms a duct space 48 communicating with the air inlets 42, an intake port 51 provided in a projection 49 of the duct cover 47 and opening downward, a partition 52 standing from an edge of the intake port 51, a first barrier plate 54 horizontally protruding from an upper end 52*a* of the partition 52, and a second barrier plate 56 provided on the duct cover 47.

Figure 4:
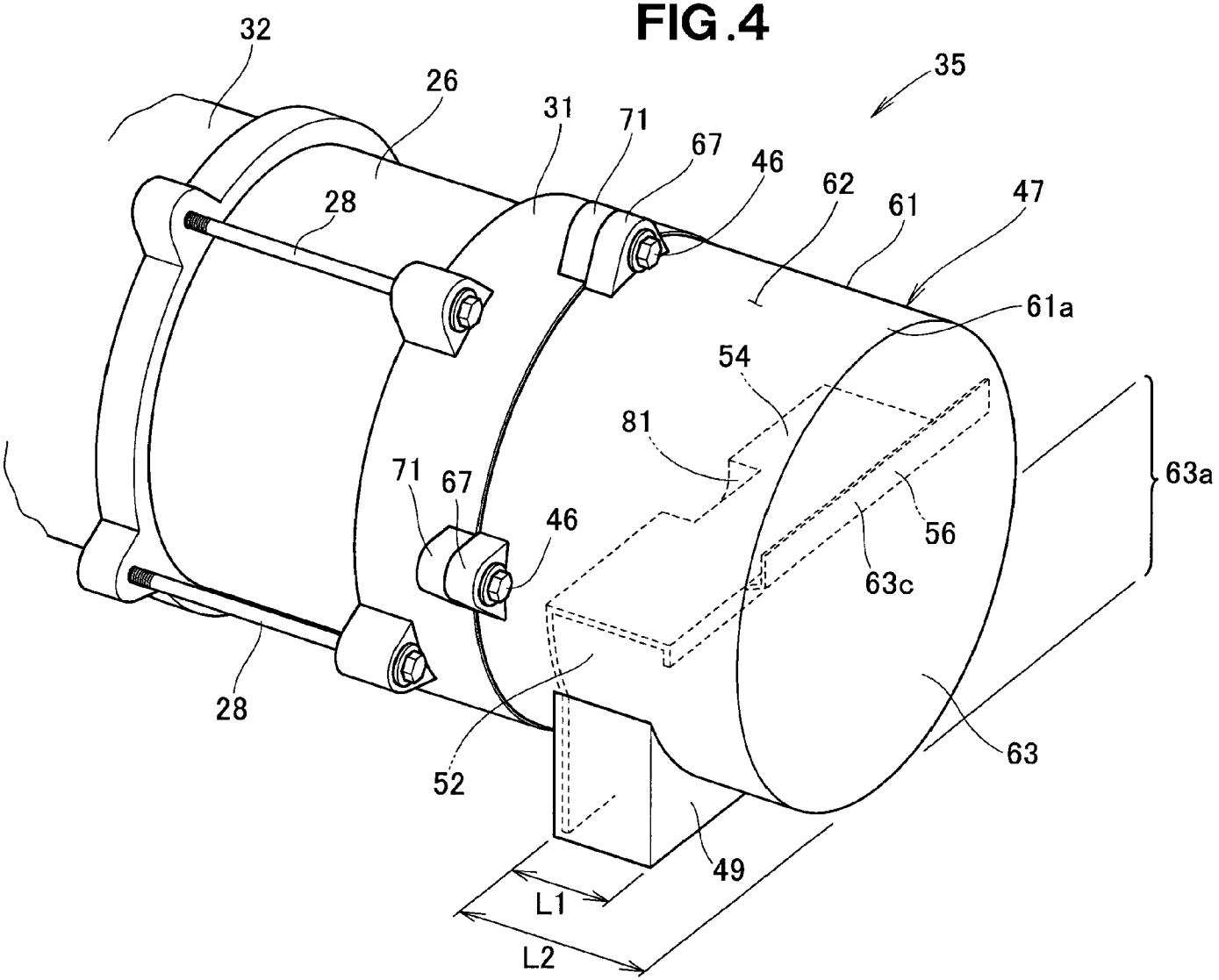
FIG. 4 is a perspective view of the intake duct of FIG. 3.
Figure 5:
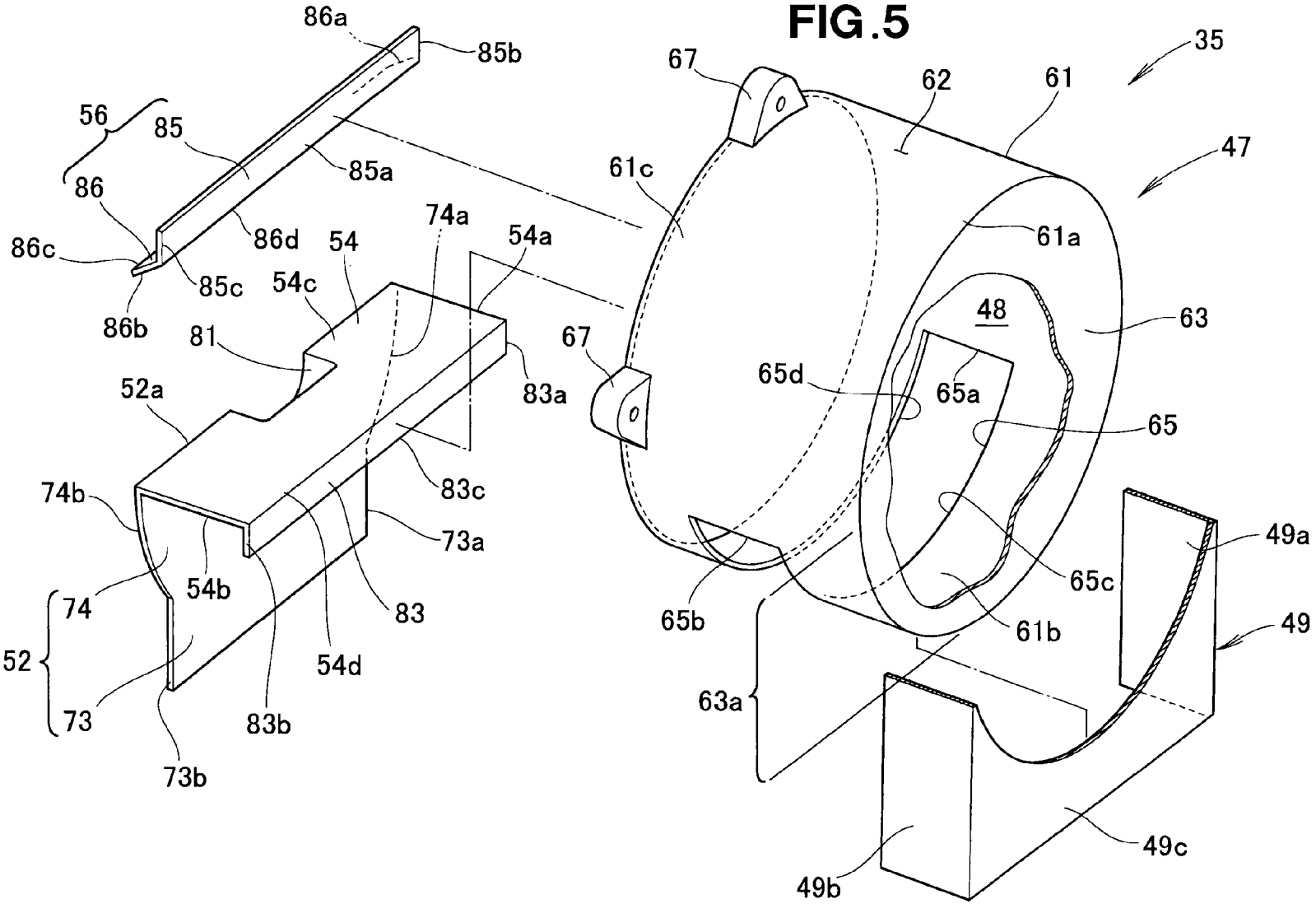
FIG. 5 is en exploded perspective view showing the intake duct of FIG. 4.

As shown in FIGS. 3, 4, and 5, the duct cover 47 includes a hollow tube 61 with a substantially cylindrical circumferential wall 62, a disc-shaped front wall 63 blocking a front end 61*a* of the tube 61, an opening 65 formed in a lower portion 61*b* of the tube 61, the lower projection 49 projecting downward from the opening 65, and a plurality of attachment portions 67 provided at equal spacing around a rear end 61*c* of the tube 61.

The duct space 48 is formed by the hollow tube 61 and the disc-shaped front wall 63. The plurality of attachment portions 67 on the duct cover 47 is attached to a plurality of attachment portions 71 on the front cover 31 with a plurality of bolts 46.

The opening 65 is formed in the lower portion 61*b* of the tube 61 and curved along the circumference. The lower projection 49 projects downward from left and right edges 65*a*, 65*b* and a front edge 65*c* of the opening 65. The lower projection 49 comprises left and right sidewalls 49*a*, 49*b* and a front wall 49*c* and formed into a "U" shape. The partition 52 is attached to a rear edge 65*d* of the opening 65 and the left and right sidewalls 49*a*, 49*b* of the lower projection 49.

The partition 52 comprises a lower half 73 and an upper half 74 and has a flat plate shape. The lower half 73 is disposed behind the front wall 49*c* of the lower projection 49 and spaced apart therefrom by a predetermined distance L1 (see also FIG. 3). Left and right straight edges 73*a*, 73*b* are attached to the left and right sidewalls 49*a*, 49*b* of the lower projection 49, respectively.

The intake port 51 shown in FIG. 3 comprises the lower half 73 and the lower projection 49. That is, the partition 52 stands from an edge of the intake port 51. The intake port 51 provided in the lower projection 49 of the duct cover 47 opens downward and communicates with the duct space 48.

Left and right curved edges 74*a*, 74*b* of the upper half 74 abut the inner circumferential surface of the circumferential wall 62 and are attached thereto. The upper half 74 is disposed to face a lower half 63*a* of the front wall 63 of the front cover 31 and spaced apart from the lower half 63*a* by a predetermined distance L2 (see also FIG. 3).

Further, the upper half 74 blocks the front wall 31*b* of the front cover 31 from the lower half of the duct space 48. Specifically, the upper half 74 faces the lower half of the front wall 31*b*. That is, the upper half 74 faces a plurality of the air inlets (the lower half of the air inlets) 42 provided in the lower half of the front wall 31*b*. The upper half 74 of the partition 52 thus blocks the plurality of air inlets 42 provided in the lower half of the front wall 31*b* from the lower half of the duct space 48.

The partition 52 is spaced apart from the front wall 31*b* of the front cover 31 by a predetermined distance L3, as shown in FIG. 3. As a result, a space 53 (see FIG. 3) can be provided between the partition 52 and the front wall 31*b*. The reason why the space 53 is provided will be described later with reference to FIG. 6B.

The first barrier plate 54 horizontally extends from the upper end 52*a* of the partition 52 into the duct space 48 and faces the intake port 51. The first barrier plate 54 has a substantially rectangular shape, and left and right edges 54*a*, 54*b* thereof abut the inner circumferential surface of the circumferential wall 62.

A recess 81 is formed at the center of the first barrier plate 54 and the partition 52 along a base end 54*c* of the first barrier plate 54 and the upper end 52*a* of the partition 52. The recess 81 accommodates the central portion (protrusion) 31*a* of the front cover 31, as shown in FIG. 3.

A folded portion 83 is formed at a front end 54*d* of the first barrier plate 54. The folded portion 83 is a protruding piece folded downward at the front end 54*d*. The folded portion 83 has a rectangular shape, and left and right edges 83*a*, 83*b* thereof abut the inner circumferential surface of the circumferential wall 62.

The first barrier plate 54 thus provided in the intake duct 35 changes the flowing direction of the air (outside air) sucked through the intake port 51 (FIG. 3) from upward to sideward. The first barrier plate 54 thus causes the air sucked through the intake port 51 to flow sideward, whereby an air flow path L4 (FIG. 3) can be extended and the flow rate of the air can be lowered. When the air flows along the extended flow path at the lowered flow rate, the moisture contained in the air has a higher chance of falling on its own and separating from the air.

Further, providing the first barrier plate 54 and the partition 52 in the duct cover 47 allows the size of the duct cover 47 to be reduced and the air flow path L4 (FIG. 3) to be extended. As a result, the frame 11 can accommodate the intake duct 35, and the engine generator 10 can be reduced in size.

Moreover, the folded portion 83 oriented downward is provided at the front end 54*d* of the first barrier plate 54. Water droplets adhering to the first barrier plate 54 are guided to the folded portion 83 by the air flowing sideward. The water droplets having been guided to the folded portion 83 travel downward along the folded portion 83 and fall from a lower end 83*c* of the folded portion 83. The moisture contained in the air can thus be adequately separated.

As shown in FIG. 3, the second barrier plate 56 is provided in parallel to an attachment portion 63*c* that is part of the front wall 63 of the duct cover 47 and spaced apart upward from the first barrier plate 54 by a predetermined distance H. The attachment portion 63*c* is where the air flowing sideward along the first barrier plate 54 is forced to flow upward.

The second barrier plate 56 includes a vertical piece 85 attached to the attachment portion 63*c* of the front wall 63 and an inclined piece 86 projecting obliquely downward from a lower end 85*a* of the vertical piece 85. The vertical piece 85 has a rectangular shape, and left and right edges 85*b*, 85*c* thereof abut the inner circumferential surface of the circumferential wall 62. The inclined piece 86 has a rectangular shape, and left and right edges 86*a*, 86*b* thereof abut the inner circumferential surface of the circumferential wall 62. Since the inclined piece 86 projects obliquely downward from the lower end 85*a* of the vertical piece 85, a front end 86*c* is positioned below a base end 86*d* (see also FIG. 3).

The air traveling upward along the duct cover 47, specifically, an upper half 63*b* of the front wall 63 (see FIG. 3) impinges on the second barrier plate 56 thus provided on the attachment portion 63*c* of the front wall 63. The moisture contained in the air therefore changes into water droplets and attaches to the second barrier plate 56. The water droplets that have attached flow downward to the front end 86*c* and fall therefrom. In this way, the moisture contained in the air is further adequately separated.

A description will now be made of an example of how the generator 17 is cooled with reference to FIGS. 6A and 6B by way of example.

Figure 6A:
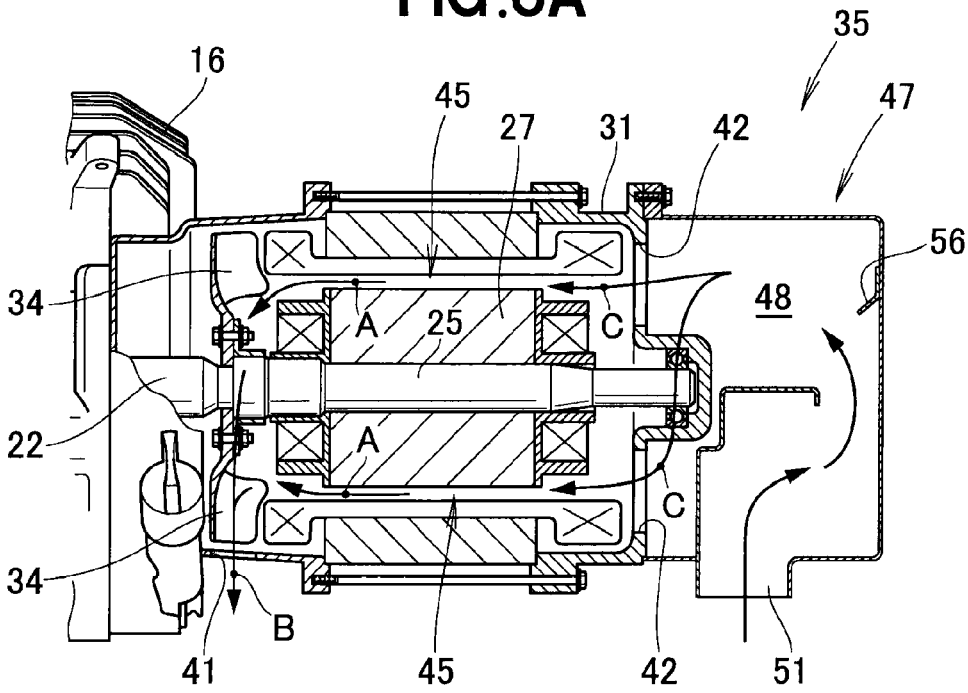
FIGS. 6A and 6B are cross-sectional views showing an example of how a cooling fan cools a generator according to the first embodiment of the present invention.

In FIG. 6A, when the engine 16 is driven, the crankshaft 22 is caused to rotate and the drive shaft 25 is caused to rotate integrally with the crankshaft 22. When the drive shaft 25 is caused to rotate, the cooling fan 34 and the rotor 27 are caused to rotate. When the cooling fan 34 is caused to rotate, the air in the cooling air sucking path 45 is guided toward the cooling fan 34, as indicated by the arrows A. The air guided toward the cooling fan 34 is discharged out of the plurality of air outlets 41, as indicated by the arrow B.

When the air in the cooling air sucking path 45 is guided toward the cooling fan 34, as indicated by the arrows A, the air in the duct space 48 is guided through the plurality of air inlets 42 formed in the front cover 31 into the cooling air sucking path 45, as indicated by the arrows C.

As an example, among the plurality of air inlets 42 provided in the front wall 31*b*, those located in the lower half of the front wall 31*b* can be configured to have a larger opening ratio than that of those in the upper half of the front wall 31*b*. In this way, the amount of air guided from the duct space 48 through the air inlets 42 in the upper half as indicated by the lower arrow C can be adjusted to further approach the amount of air guided from the duct space 48 through the air inlets 42 in the lower half as indicated by the upper arrow C.

When the air in the duct space 48 is guided into the cooling air sucking path 45 as indicated by the arrows C, the outside air (air) is introduced through the intake port 51 into the duct space 48, as indicated by the arrows. The outside air (air) introduced through the intake port 51 contains rainwater that has bounced upward off the ground or other surfaces in the form of airborne moisture and water mist.

Figure 6B:
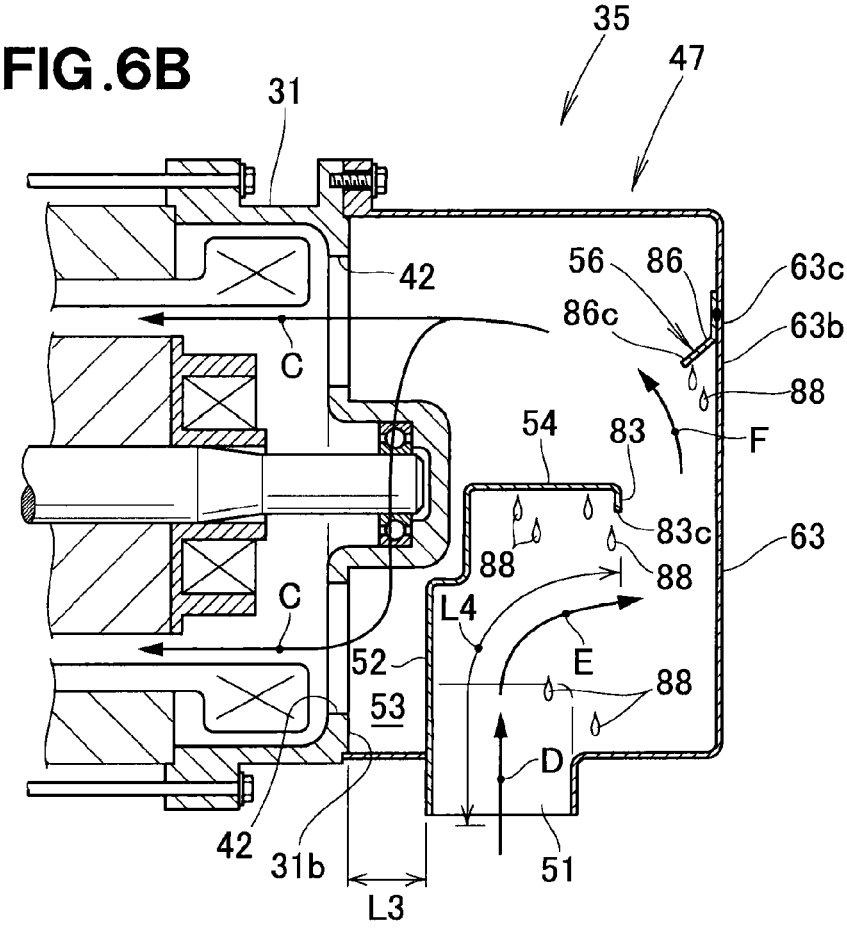

In FIG. 6B, the outside air (air) introduced through the intake port 51 into the duct space 48 travels upward toward the first barrier plate 54, as indicated by the arrow D. The air traveling upward toward the first barrier plate 54 impinges on the first barrier plate 54. The air having impinged on the first barrier plate 54 changes its direction and now flows sideward along the first barrier plate 54, as indicated by the arrow E.

The first barrier plate 54 causes the air sucked through the intake port 51 to flow sideward, whereby the air flow path L4 can be extended and the flow rate of the air can be lowered. When the air flows along the extended flow path L4 at the lowered flow rate, the moisture contained in the air (airborne moisture and water mist) has a higher chance of falling on its own in the form of water droplets 88 and separating from the air. The water droplets 88 having fallen on their own are discharged out of the intake port 51.

The folded portion 83 oriented downward is provided at the front end 54*d* of the first barrier plate 54. The water droplets having attached to the first barrier plate 54 are guided to the folded portion 83 by the air flowing sideward. The water droplets having been guided to the folded portion 83 travel downward along the folded portion 83 and fall from the lower end 83*c* of the folded portion 83.

The second barrier plate 56 is attached to the front wall 63 of the duct cover 47, specifically, the attachment portion 63*c* where the air flowing sideward along the first barrier plate 54 is forced to flow upward. The second barrier plate 56 projects obliquely downward so that the front end 86*c* is in a relatively lower position. The air traveling upward along the upper half 63*b* of the front wall 63, as indicated by the arrow F, impinges on the inclined piece 86 of the second barrier plate 56, and the moisture contained in the air (airborne moisture and water mist) attaches to the inclined piece 86 in the form of water droplets 88. The water droplets 88 having attached to the inclined piece 86 flow down to the front end 86*c* and fall therefrom.

The air traveling upward along the upper half 63*b* of the front wall 63 is guided to the air inlets 42 in the front cover 31 and guided through the air inlets 42 into the generator 17.

Providing the intake port 51 oriented downward and the first and second barrier plates 54, 56 in the intake duct 35 as described above allows the moisture contained in the air (airborne moisture and water mist) to be separated.

As described above, even when rainwater bounced upward off the ground or other surfaces becomes airborne moisture and water mist and enters the intake port 51, the airborne moisture and water mist can be separated from the air. The air from which the moisture has been removed is guided through the air inlets 42 in the front cover 31 into the cooling air sucking path 45, as indicated by the arrows C.

The space 53 is provided between the partition 52 and the front wall 31*b*, whereby the air can be smoothly guided to the air inlets 42 formed in the lower half of the front cover 31, as indicated by the lower arrow C. As a result, the air can be guided to all the air inlets 42 in the front cover 31 in a substantially uniform manner, as indicated by the arrows C. In this way, the moisture contained in the air will not be guided into the generator 17, and the air from which the moisture has been removed can efficiently cool the generator 17.

An intake duct 90 according to a second embodiment will be described with reference to FIG. 7. The components that are the same as those in the first embodiment have the same reference characters, and description of these components will be omitted.

Figure 7:
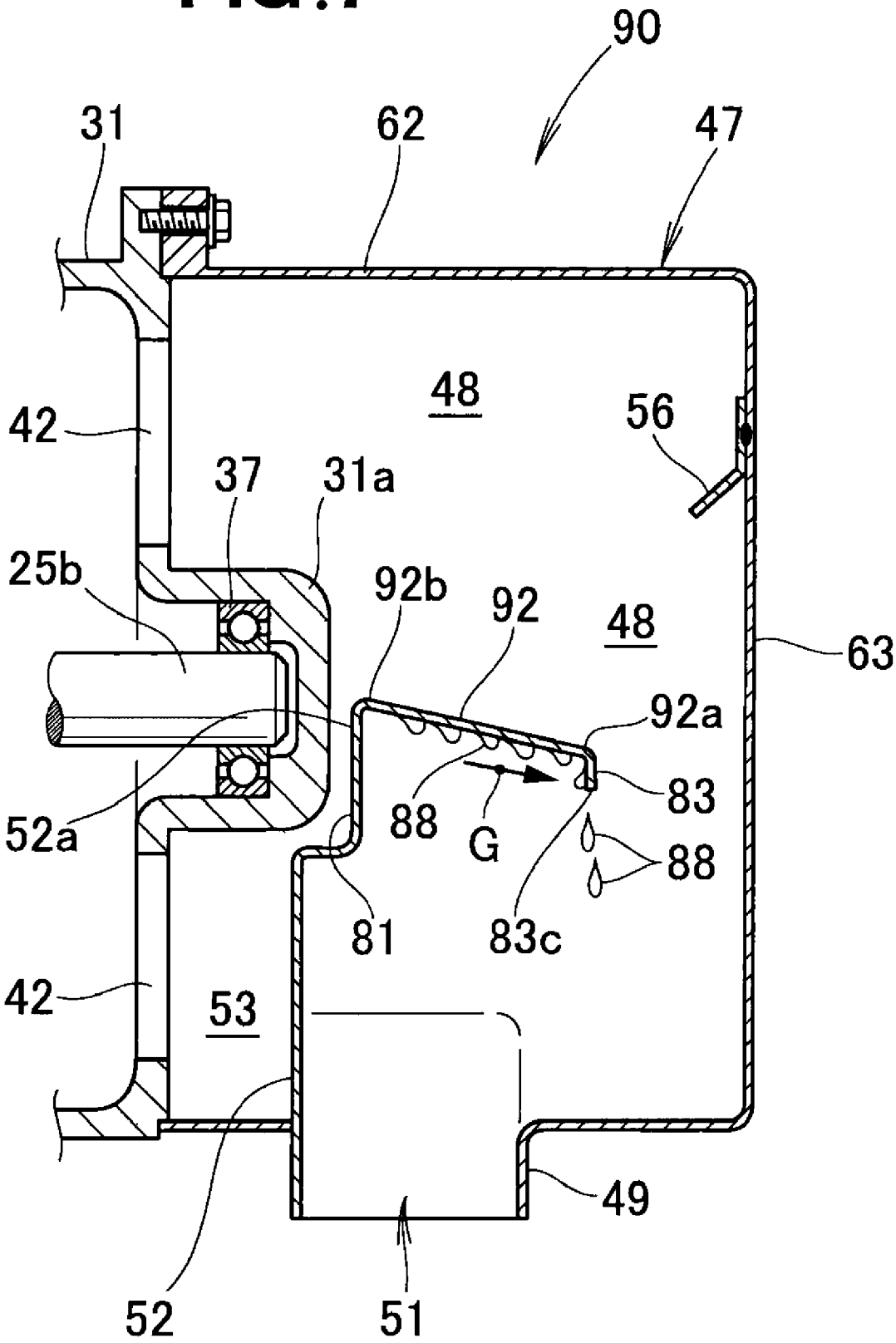
FIG. 7 is a cross-sectional view of an intake duct according to a second embodiment of the present invention.

FIG. 7 shows that the intake duct 90 differs from the intake duct according to the first embodiment in that the first barrier plate 54 is inclined downward.

A first barrier plate 92 extends sideward in the duct space 48 and is inclined downward in such a way that a front end 92*a* is lower than a base end 92*b*. Therefore, water droplets 88 adhering to the first barrier plate 92 more readily flow down to the front end 92*a*, as indicated by the arrow G, and smoothly fall from the lower end 83*c* of the folded portion 83. In this way, the moisture contained in the air is separated from the air.

While the above embodiments have been described with reference to the case where the folded portion 83 is provided at the front end 54*d* of the first barrier plate 54, the folded portion 83 may or may not be present as appropriate.

While the above embodiments have been described with reference to the case where the second barrier plate 56 is provided in the duct cover 47, the second barrier plate 56 may or may not be present as appropriate.

Further, the air inlets 42, the duct cover 47, the duct space 48, the intake port 51, the partition 52, the first barrier plate 54, the second barrier plate 56, the folded portion 83, and other components shown in the above embodiments do not necessarily have the illustrated shapes, but may have other shapes as appropriate.

The invention is suitably applicable to an engine generator in which an engine drives a generator and rotates a cooling fan and cooling air sucked by the cooling fan is guided into the generator.

Obviously, various minor changes and modifications of the present invention are possible in light of the above teaching. It is therefore to be understood that within the scope of the appended claims the invention may be practiced otherwise than as specifically described.

What is claimed is:

1. An engine generator in which an engine having a crankshaft drives a generator having a drive shaft coupled to the crankshaft of the engine and causes a cooling fan to rotate, and cooling air sucked by the cooling fan is guided into the generator through a plurality of air inlets, the engine generator comprising:

an intake duct having a duct space communicating with the air inlets;

an intake port provided in a lower portion of the intake duct, oriented orthogonally relative to the drive shaft of the generator, and communicating with the duct space;

a partition defining an edge of the intake port, the partition extending orthogonally relative to the drive shaft of the generator, and located directly opposite at least one of the air inlets; and a first barrier plate extending from a free end of the partition into the duct space and directly opposing the intake port.

2. The engine generator of claim 1, wherein the first barrier plate has a front end and a folded portion folded at the front end and oriented downward.

3. The engine generator of claim 1, wherein the first barrier plate extends laterally into the duct space and has a folded portion extending downward from a front end of the first barrier plate in a direction toward the intake port.

4. The engine generator of claim 1, wherein the intake duct includes a second barrier plate disposed on the portion of the intake duct wall where the air flowing along the first barrier plate is forced to flow upward, the second barrier plate having a front end projecting obliquely downward toward the first barrier plate.

* * * * *